US010941907B2

(12) United States Patent
Price

(10) Patent No.: US 10,941,907 B2
(45) Date of Patent: Mar. 9, 2021

(54) TROFFER RETROFIT KIT

(71) Applicant: Current Lighting Solutions, LLC, East Cleveland, OH (US)

(72) Inventor: Alex Kendall Price, East Cleveland, OH (US)

(73) Assignee: Current Lighting Solutions, LLC, East Cleveland, OH (US)

( * ) Notice: Subject to any disclaimer, the term of this patent is extended or adjusted under 35 U.S.C. 154(b) by 434 days.

(21) Appl. No.: 15/364,924

(22) Filed: Nov. 30, 2016

(65) Prior Publication Data

US 2018/0149319 A1 May 31, 2018

(51) Int. Cl.

| | |
|---|---|
| ***F21K 9/275*** | (2016.01) |
| ***F21V 23/00*** | (2015.01) |
| ***F21K 9/278*** | (2016.01) |
| ***F21S 8/02*** | (2006.01) |
| ***F21V 3/02*** | (2006.01) |
| ***F21V 17/16*** | (2006.01) |
| ***F21K 9/20*** | (2016.01) |
| ***F21Y 115/10*** | (2016.01) |
| *F21V 21/04* | (2006.01) |
| *F21S 8/04* | (2006.01) |

(Continued)

(52) U.S. Cl.

CPC ..... *F21K 9/275* (2016.08); *F21K 9/278* (2016.08); *F21S 8/026* (2013.01); *F21V 3/02* (2013.01); *F21V 17/164* (2013.01); *F21V 23/005* (2013.01); *F21V 23/009* (2013.01); *F21K 9/20* (2016.08); *F21S 8/04* (2013.01); *F21V 21/025* (2013.01); *F21V 21/03* (2013.01); *F21V 21/04* (2013.01); *F21V 21/044* (2013.01); *F21Y 2115/10* (2016.08)

(58) Field of Classification Search

CPC ..... F21K 9/275; F21K 9/278; F21K 9/235; F21K 9/237; F21K 9/27; F21K 9/272; F21S 8/026; F21S 8/04; F21S 8/043; F21S 8/02; F21S 8/03; F21V 21/048; F21V 21/049; F21V 21/047; F21V 21/044; F21V 21/03; F21V 21/04; F21V 21/042; F21V 21/045; F21V 21/046; F21V 21/041; F21V 21/025; E04B 9/006

See application file for complete search history.

(56) References Cited

U.S. PATENT DOCUMENTS 2,717,955 A * 9/1955 Schwemmer ..... F21S 8/02 362/147
3,248,537 A * 4/1966 Docimo ..... F21S 8/02 362/451

(Continued)

FOREIGN PATENT DOCUMENTS

DE 102010006360 A1 * 8/2011 ..... E04B 9/22
FR 2995660 A1 * 3/2014 ..... F21V 21/047

OTHER PUBLICATIONS

Luedi, Aug. 4, 2011, DE102010006360A1, English (Year: 2011).*

(Continued)

*Primary Examiner* — Bryon T Gyllstrom
*Assistant Examiner* — James M Endo
(74) *Attorney, Agent, or Firm* — Buckley, Maschoff & Talwalkar LLC

(57) ABSTRACT

A retrofit kit for a luminaire including a door configured to sit below a ceiling plane of the luminaire.

17 Claims, 11 Drawing Sheets

(51) Int. Cl.
*F21V 21/03* (2006.01)
*F21V 21/02* (2006.01)

(56) References Cited

U.S. PATENT DOCUMENTS 3,545,145 A * 12/1970 Yousefpor ..... F21V 21/04 52/28
4,528,764 A * 7/1985 Cobb ..... G09F 13/04 40/553
5,902,035 A * 5/1999 Mui ..... F21S 8/02 362/147
6,179,451 B1 * 1/2001 Bodine ..... E04B 9/001 362/147
6,367,955 B1 * 4/2002 Rhee ..... F21S 8/02 362/368
7,753,550 B2 * 7/2010 Engel ..... F21V 7/0016 362/147
7,922,354 B2 * 4/2011 Everhart ..... F21V 23/009 362/235
9,182,091 B2 11/2015 Gershaw
9,279,553 B1 3/2016 Scribante et al.
2007/0211457 A1 * 9/2007 Mayfield, III ..... F21S 8/02 362/223
2012/0051050 A1 * 3/2012 Lee ..... F21S 2/005 362/235
2012/0113628 A1 5/2012 Burrow et al.
2013/0294074 A1 * 11/2013 Engel ..... F21V 13/02 362/235
2014/0126199 A1 * 5/2014 Heeter ..... F21V 21/08 362/223
2014/0268747 A1 * 9/2014 Demuynck ..... F21S 9/022 362/235
2015/0085476 A1 * 3/2015 Mandy ..... F21S 8/026 362/147
2015/0267905 A1 * 9/2015 Lee ..... F21V 21/048 362/150
2016/0153641 A1 6/2016 Fang et al.

OTHER PUBLICATIONS

Duchateau, Encased security light for displaying sign in e.g. public premise, has housing including opening facing LED, and another housing including another opening, where housings are secured such that openings of housings are in communication, Mar. 21, 2014, FR2995660A1, English (Year: 2014).*

* cited by examiner

TROFFER RETROFIT KIT

TECHNICAL FIELD

The present disclosure relates to troffers for mounting luminaires. More particularly, the present disclosure relates to troffer retrofit kits.

BACKGROUND

In typical indoor lighting applications, it is not uncommon to find recessed troffers used to house fluorescent light bulbs. These troffers typically vary in width, in the same building, depending on room size and desired light output in a particular area of the building. With the advent of new light emitting diode (LED) technologies, which yield increased light output at a much reduced cost compared to fluorescent and incandescent light bulbs, there is a trend to replace fluorescent light bulbs with LEDs.

However, many of the troffers that customers need retrofitted may be over 25 years old, thus making it difficult to know the exact width of the replacement fixture or retrofit kit to be installed and any variances in its design compared to typical replacement fixtures or retrofit kits. Current LED retrofit kits are made to fit a single recessed troffer, or at best a series of recessed troffers designed by the same manufacturer. Additionally, today's LED retrofit kits cannot account for the varying widths of troffers, which in turn means that manufacturers have to create multiple iterations of the same retrofit kit or offer custom solutions on an as-needed basis.

SUMMARY

The embodiments featured herein help solve or mitigate the above noted issues as well as other issues known in the art. For example, the embodiments provide kits to retrofit existing or installed troffers of different widths with a single universal retrofit kit assembly. The embodiments can include a single unique bracket, a belly pan, and a door assembly.

One embodiment provides a retrofit kit for a luminaire. The retrofit kit includes a door configured to sit below a ceiling plane of the luminaire.

Another embodiment provides a kit for a luminaire. The kit includes a belly pan supported by a set of brackets. The belly pan is disposed within a recessed troffer placed above a ceiling plane of the luminaire. Furthermore, the belly pan is covered by a door mounted below the ceiling plane.

Another embodiment provides a kit for a luminaire. The kit includes a troffer recessed above a ceiling plane of the luminaire. The kit further includes a door disposed below the ceiling plane of the luminaire.

The embodiments differs from typical retrofitting solutions at least because the embodiments may achieve universality across virtually all known luminaires and their design constraints. For instance, exemplary retrofit kits may include a door assembly installed below the surface plane of the ceiling, thus providing universality for interfacing with a wide variety of already installed troffers.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

The embodiments provide several structural features that are advantageous over typical retrofit kits. For example, unlike typical retrofit kits, an exemplary retrofit kit according to the teachings featured herein is a universal kit that will work with a wide variety of luminaires, regardless of their manufacturer.

Moreover, some of the embodiments utilize a single door and a set of dimensions that directly correlate to an entire range of troffers. Furthermore, in some embodiments, the door assembly is installed below the surface plane of the ceiling, whereas typical kits utilize a door that is recessed within the existing troffer, equal to or above the ceiling plane. In other words, in the embodiments, the door is not recessed within the existing troffer.

Figure 1:
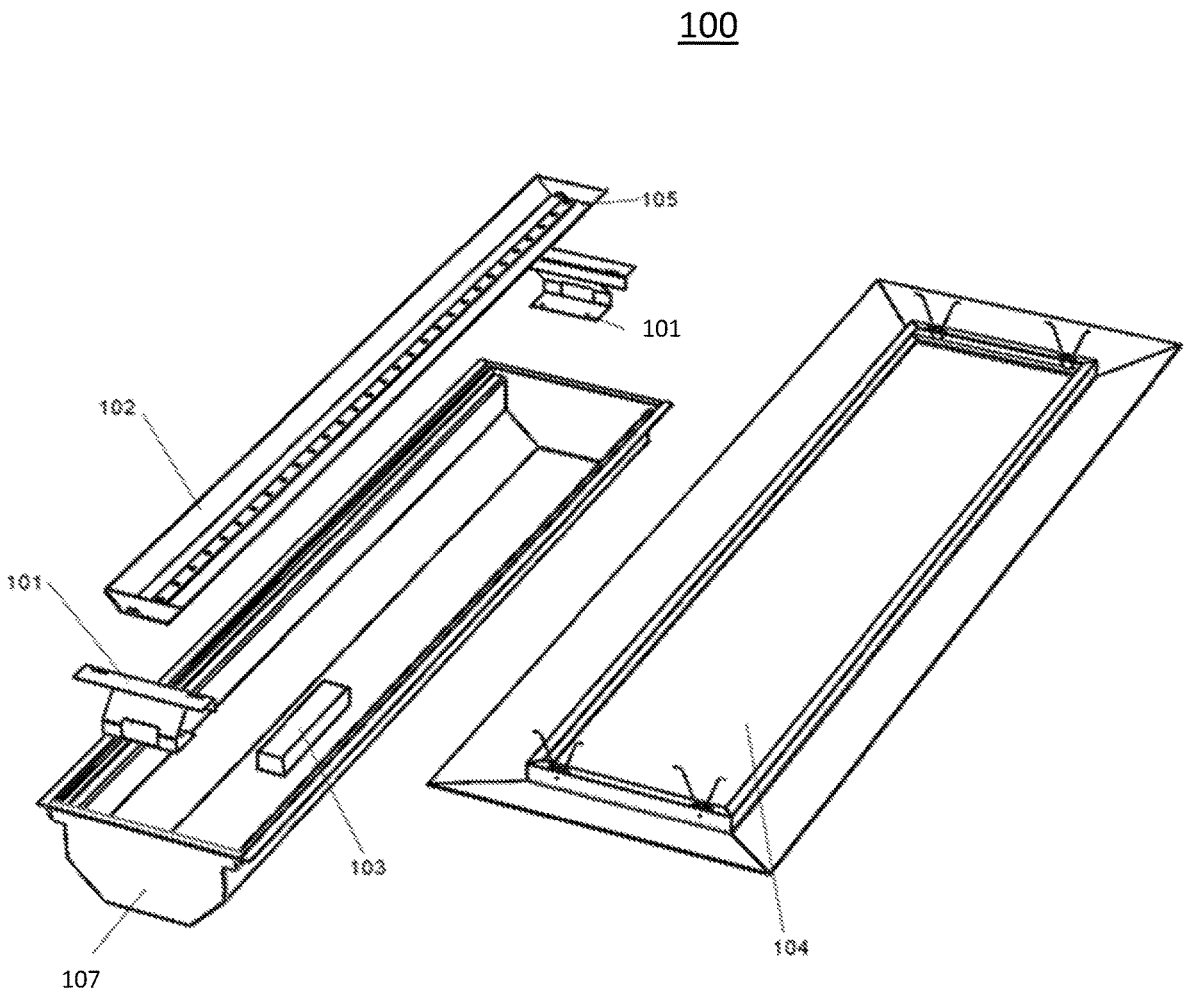
FIG. 1 illustrates a retrofit kit assembly in accordance with several aspects described herein.

FIG. 1 illustrates a retrofit kit assembly 100 according to one embodiment. The retrofit kit assembly 100 includes a set of brackets 101, a belly pan 102, a driver 103, and a door assembly 104. The belly pan 102 is an assembly that includes a pan, which may be constructed through a variety of materials and methods known to one of skill in the art.

The belly pan 102 further includes an active light source 105 that may be mechanically fastened to the belly pan 102. The active light source 105 can be a set of LEDs. Upon field assembly, the belly pan 102 can be mechanically fastened to the set of brackets 101, which can be, by example and not by limitation, mechanical fasteners.

Figure 4:
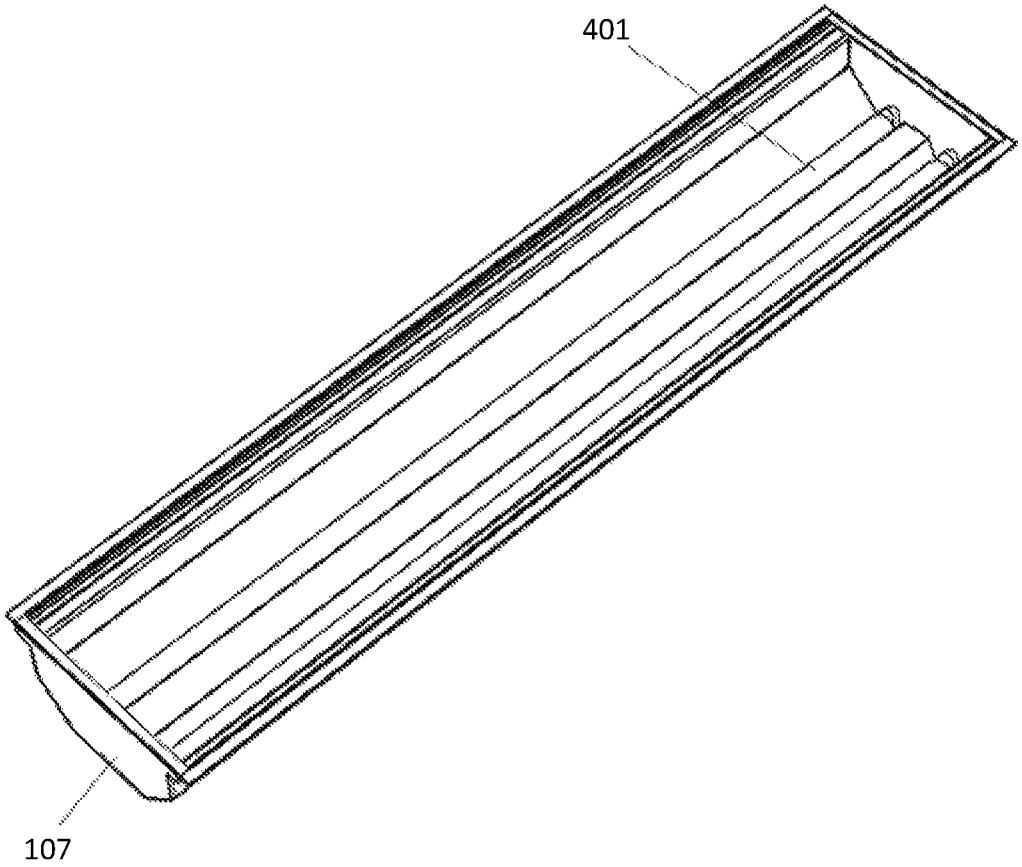
FIG. 4 illustrates a troffer in accordance with several aspects described herein.
Figure 5:
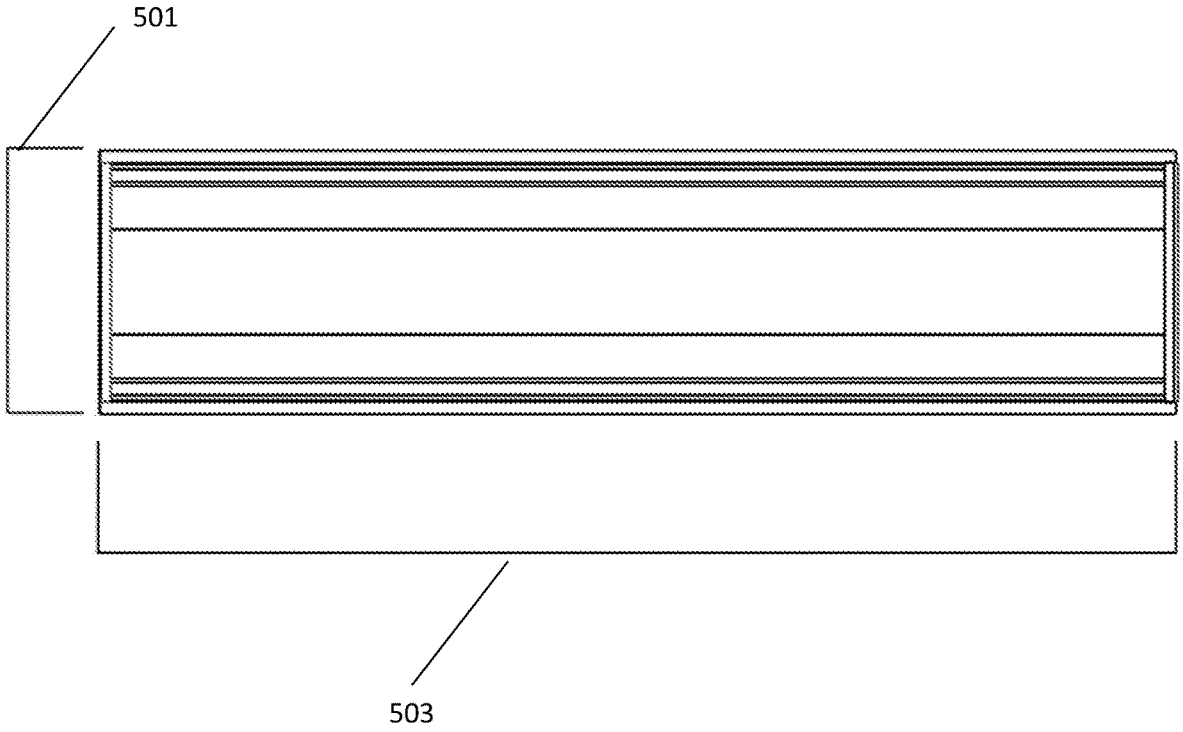
FIG. 5 illustrates a partial view of a troffer in accordance with several aspects described herein.

The retrofit kit assembly 100 is configured for replacement of fluorescent tubes 401 (see FIG. 4) within a troffer 107. As shown in FIG. 5, the troffer 107 has a width 501 and a length 503. Typically, the length 503 is about 48 inches and does not vary in the industry, whereas different troffers can have different widths 501.

The retrofit kit assembly 100 of FIG. 1 utilizes the constant length 503 of the troffer 107 in order to achieve universality. It is noted that the door assembly 104 of the retrofit kit 100 sits below the ceiling plane of luminaire, as shall be described further with respect to FIGS. 7 and 8.

Figure 2:
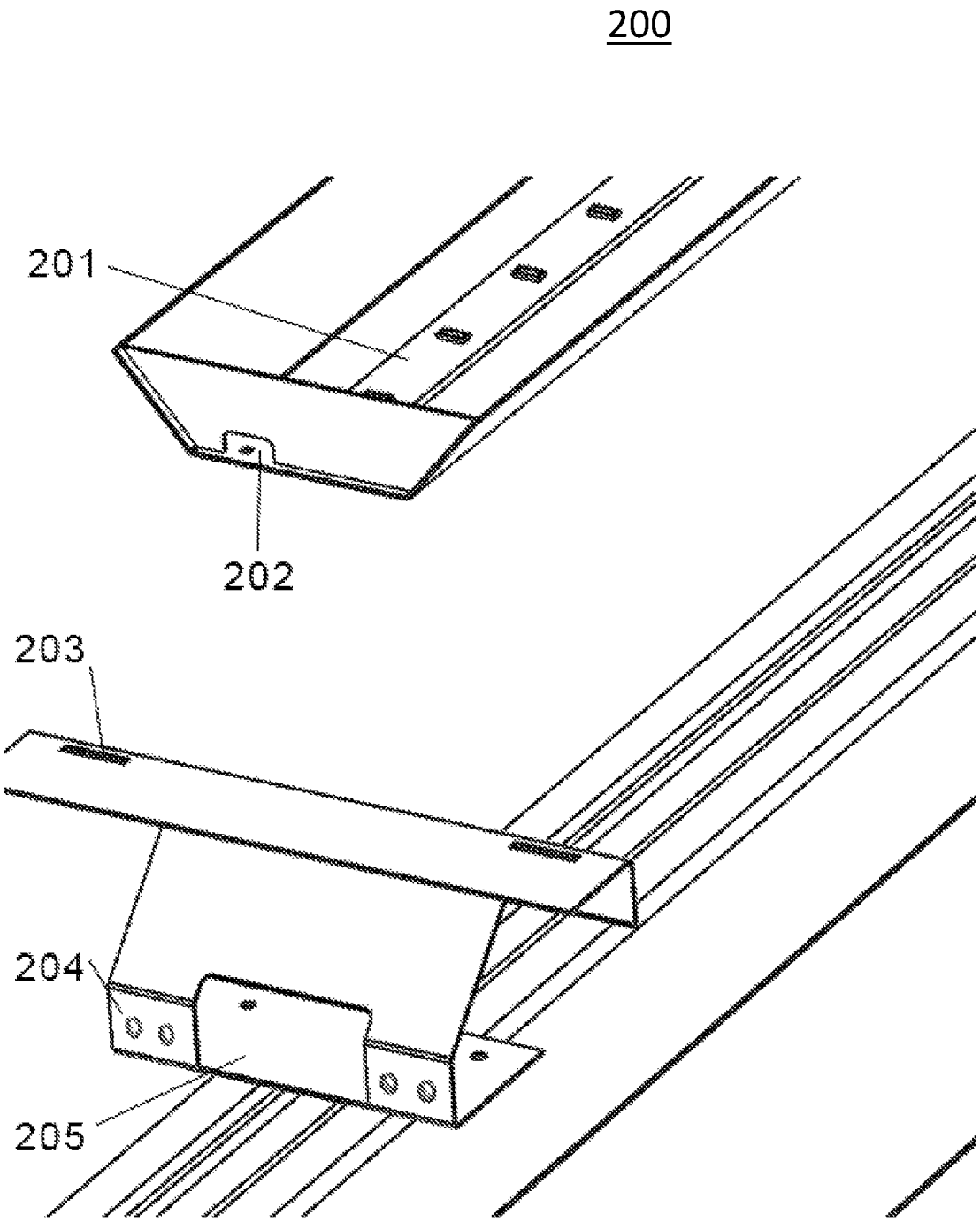
FIG. 2 illustrates a partial view of a retrofit kit assembly in accordance with several aspects described herein.

Referring now to FIG. 2, which shows a partial view 200 of the retrofit kit assembly 100, each bracket of the set of brackets 101 includes features that are used to attach the door assembly 104 to the troffer 107. Each bracket 101 includes a hole 204 that allows the bracket 101 to be mechanically fastened to the troffer 107, using, for example and not by limitation, mechanical fasteners. Each bracket 101 also has a flange that includes a hole 203, allowing the belly pan 102 to be mechanically fastened to the bracket 101.

The circuit board 201 can be an LED populated circuit board or any other active light-emitting component. Furthermore, the hole 202 allows the belly pan 102 to be fastened to a bracket 101 via a flange 205 of the bracket 101, which supports the belly pan 102. One of skill in the art will readily recognize that the placement of circuit board 201, the hole 202, and the flange 205 are for exemplary purposes. Other arrangements can be devised without departing from the scope of the present disclosure.

Figure 3:
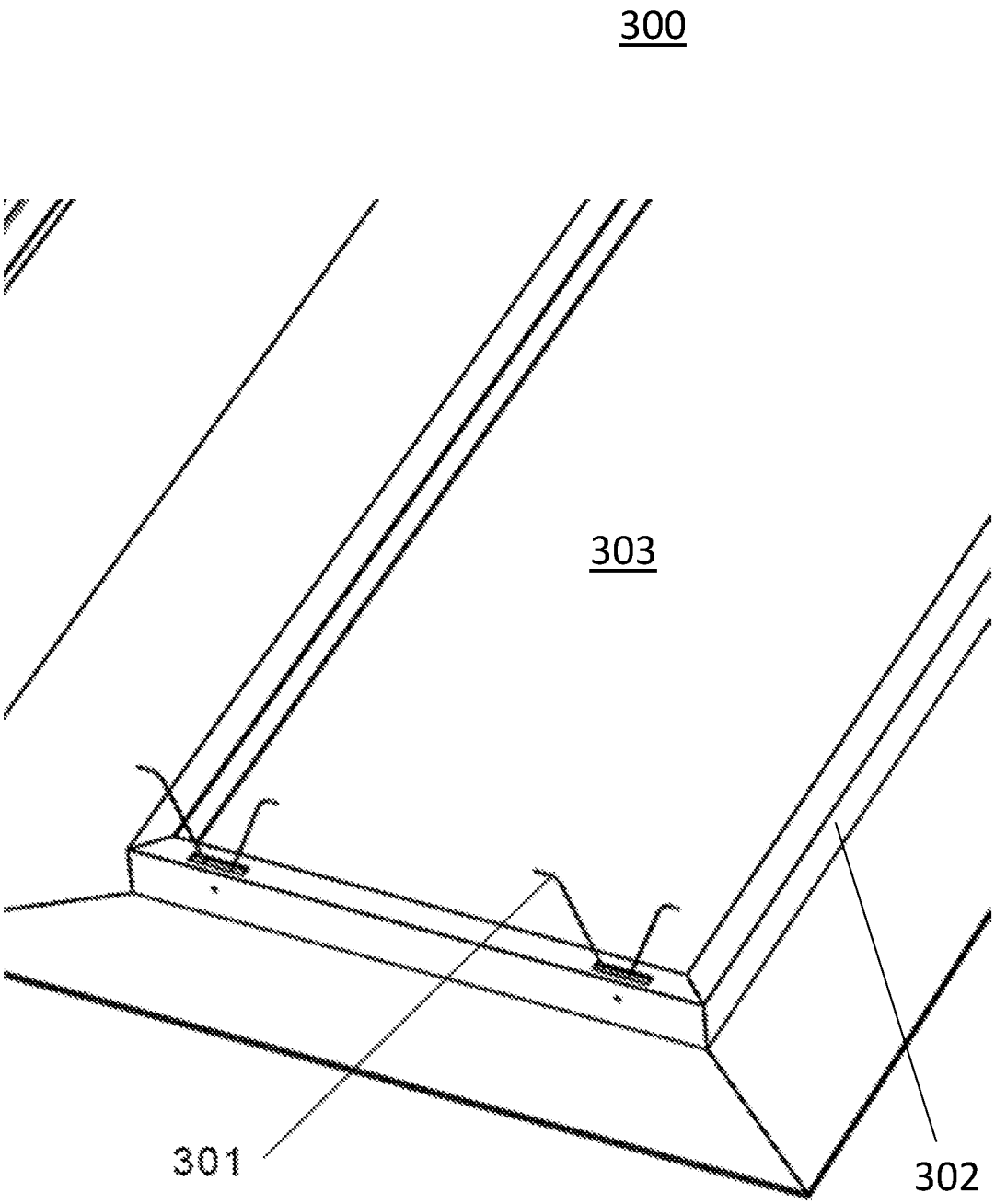
FIG. 3 illustrates a door assembly in accordance with several aspects described herein.

FIG. 3 illustrates a partial view 300 of the door assembly 104. The door assembly 104 includes a set of spring clips 301 that may be mechanically fastened to a frame 302 of the door 303, or the set of spring clips 301 may be secured by a feature designed into the frame 302. In some embodiments, the frame 302 may be constructed of sheet metal, extruded plastic or by other means, and the door 303 may include a lens and/or a diffuser.

Figure 6:
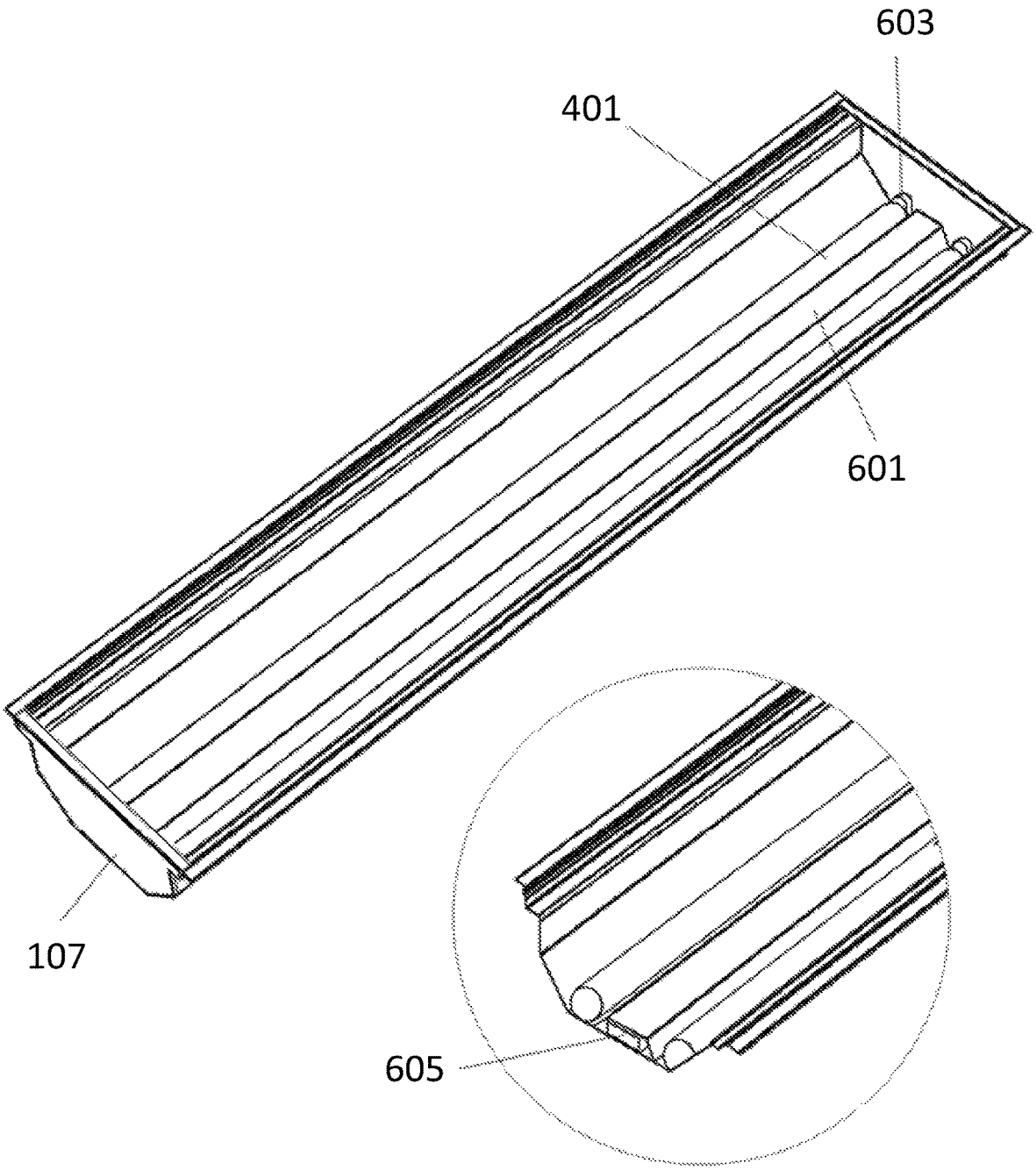
FIG. 6 illustrates a troffer in accordance with several aspects described herein.

FIG. 6 illustrates the troffer 107 retrofitted with several components of the exemplary retrofit kit assembly 100. Specifically, the troffer 107 can initially include fluorescent bulbs 401 that are secured at either end of the troffer 107 pan by tombstones 603. The troffer 107 can further include fitting therein a ballast (or LED driver) 605 that is covered by a ballast cover 601. It is noted that in some embodiments, the ballast (or LED driver) 605 can be included in an existing troffer 107, whereas in others, it can be part of the exemplary retrofit kit.

Figure 7:
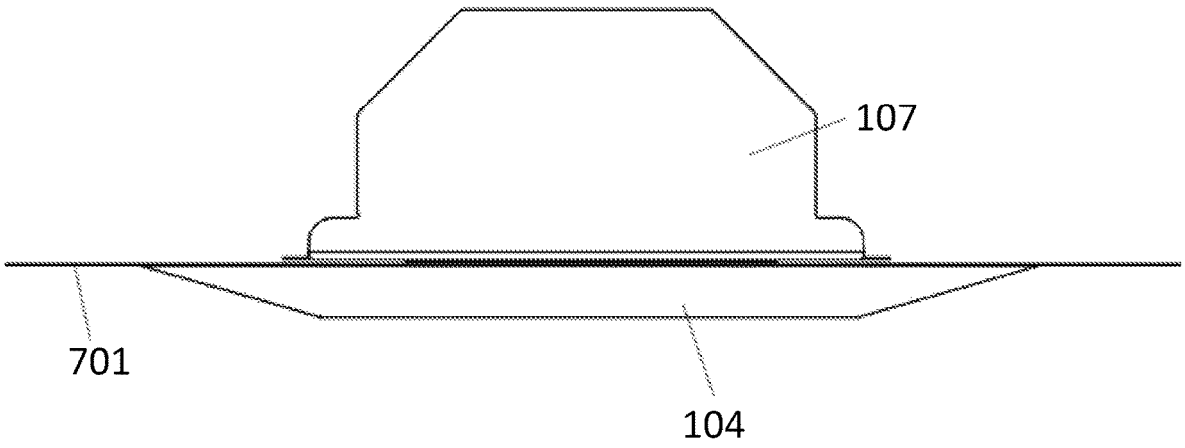
FIG. 7 illustrates a retrofit kit assembly in accordance with several aspects described herein.
Figure 8:
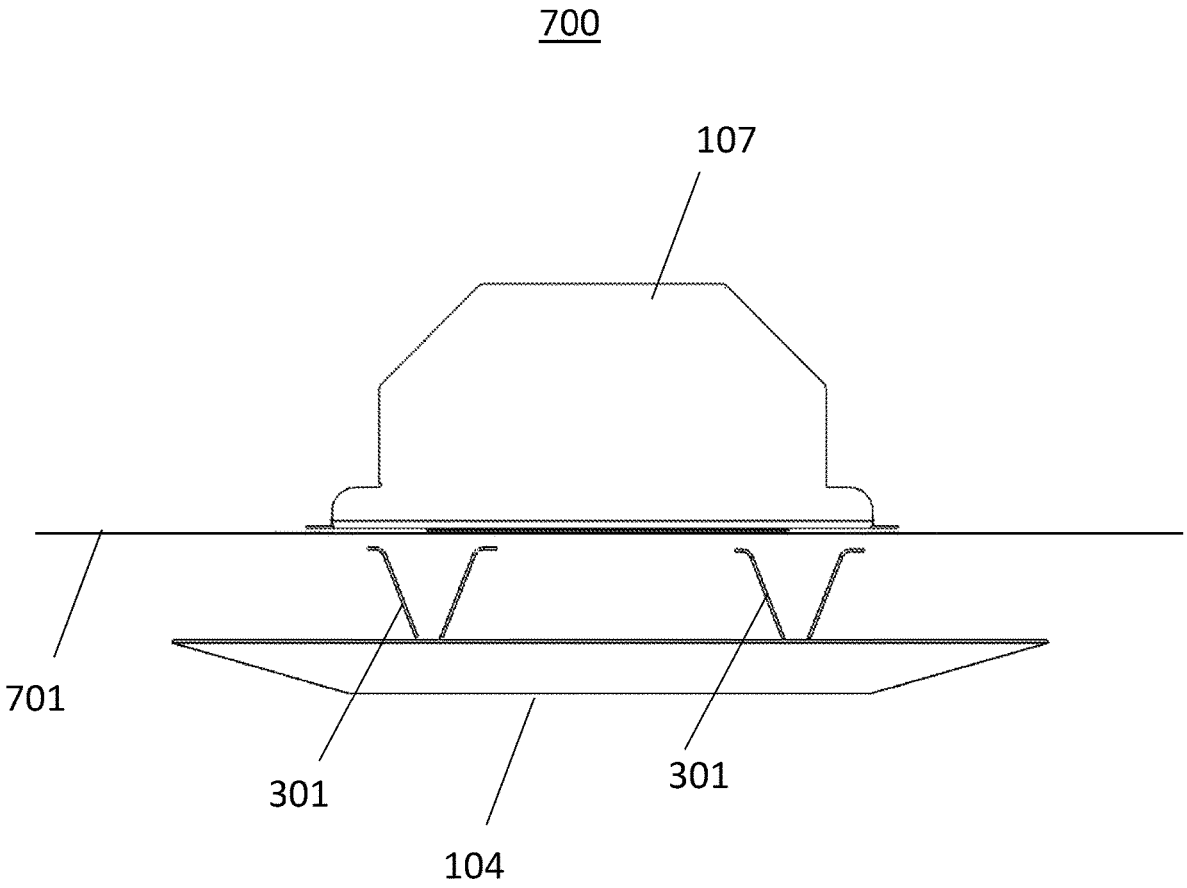
FIG. 8 illustrates a retrofit kit assembly in accordance with several aspects described herein.
Figure 9:
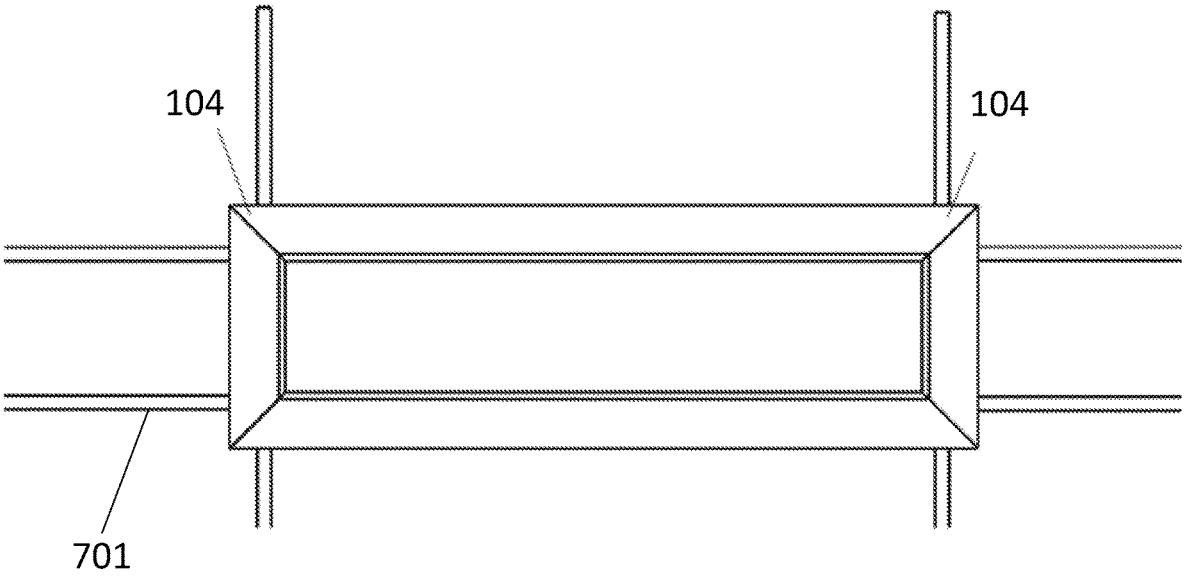
FIG. 9 illustrates a view a retrofit kit assembly mounted on a ceiling grid in accordance with several aspects described herein.
Figure 10:
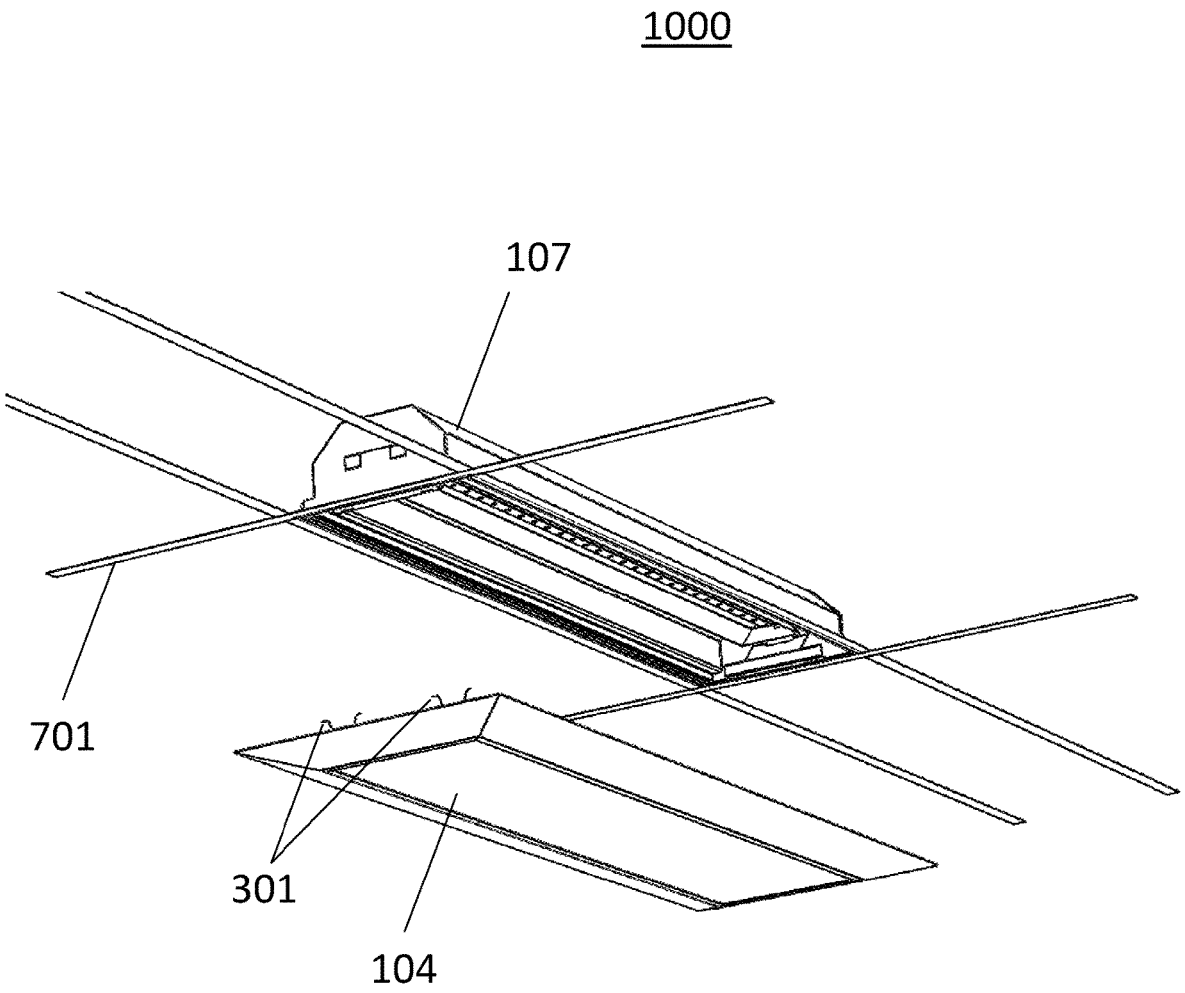
FIG. 10 illustrates a view of a retrofit kit assembly mounted on a ceiling grid in accordance with several aspects described herein.

FIGS. 7, 8, 9, and 10 depict how the door assembly 104 achieves universality of the retrofit kit assembly 100 during installation. (FIGS. 7 and 8 are cross-sectional views, FIG. 9 is a bottom view, and FIG. 10 is a perspective view of a luminaire 1000.) The retrofit kit assembly 100 combines the use of a door assembly 104 and brackets (not shown in FIGS. 7 and 8) in such a way that the door assembly 104 is disposed below the ceiling plane 701 of the luminaire. The door assembly 104 can be mechanically attached to the brackets 101, allowing the width 501 of the troffer 107 to vary as the door will simply cover more or less of the troffer 107 and the ceiling plane 701, depending on the width 501 of the troffer 107 (see FIG. 5).

Figure 11:
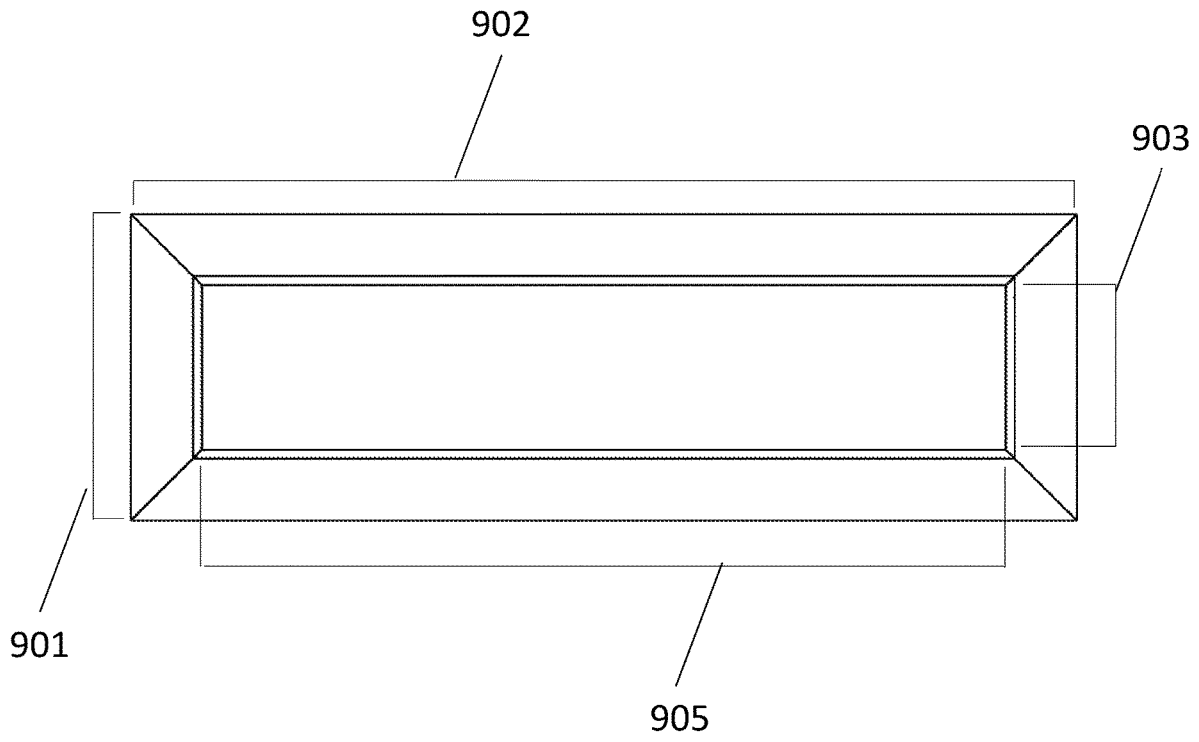
FIG. 11 illustrates a view of a door assembly in accordance with several aspects described herein.

Referring now to FIG. 11, the door assembly 104 has an overall width 901 and an overall length of 902, determined by the maximum width and length dimensions possible for the T-Grid supporting a recessed troffer 107. The opening in the door assembly 104, which houses the lens/diffuser of the door 303, can have a maximum width 903 that corresponds directly to the minimum width 501 in which the troffer 107 may be placed.

Furthermore, the opening in the door assembly 104 can have a maximum length 905, corresponding directly to the maximum length of light opening the troffer 107 may have (i.e., the length 503). This correlation between the dimensions of the door assembly 104 and those of the existing troffer 107 assures that the door assembly 104 fully covers the troffer 107 while still providing the maximum width for the door 303 that is a suitable opening for light to exit the fixture.

Generally, some embodiments can include a retrofit kit for a luminaire that includes a troffer initially configured to hold fluorescent light bulbs. In short, the retrofit kit configures the troffer to hold LEDs, thus allowing one to convert a fluorescent bulb-based luminaire to a LED-based luminaire. The retrofit kit can include a door assembly configured to sit below a ceiling plan of the luminaire. The retrofit can further comprising a set of bracket supporting a belly pan disposed within a troffer of the luminaire. The retrofit kit can further include a belly pan including a set of light emitting diodes and a driver circuit for driving the light emitting diodes.

Other embodiments can include a kit that includes a belly pan supported by a set of brackets. The belly pan is disposed within a recessed troffer disposed above a ceiling plane of the luminaire, and the belly pan is covered by a door mounted below the ceiling plane. The belly pan is disposed between the troffer and the door, and the belly pan is fastened to the troffer using a set of brackets.

In yet other embodiments, the kit for the luminaire can include a troffer recessed above a ceiling plane of the luminaire. And the kit includes a door assembly disposed below the ceiling plane of the luminaire. The length of the troffer can be about 48 inches. Without loss of generality, other dimensions the troffer length can be either shorter or longer than 48 inches, and the door assembly can be adjusted accordingly. The door included in the door assembly can overlap the length of the troffer, and thus can be, in some embodiments, greater than about 48 inches.

The embodiments confer several technical and commercial advantages. For example, the embodiments eliminate the need for multiple 1×4 retrofit kits within a given product portfolio, as the embodiments can be used with virtually any standard troffer. As such, the embodiments obviate the need for different product SKUs that would otherwise be necessary to fit even a narrow range of recessed troffers.

Furthermore, the embodiments eliminate the overhead typically encountered in lighting design. Specifically, known that an LED retrofit kit can readily be installed in virtually any common recessed troffer, lighting designers consequently spend less time evaluating which fixtures are installed and which type of retrofit kit is necessary to convert the installed fixtures to LED-based light fixtures.

The embodiments also eliminate engineering overhead because they can fit virtually any 4-foot troffer ranging from 9 to 12 inches in width, which in turn eliminates the need for custom-designed products which are often specific to a single customer and not suitable as a permanent addition to a manufacturer's product portfolio. This advantage, in turn, decreases the potential need for outsourcing the manufacture of a retrofit kit and can thus increase the manufacturer's profit margin.

The embodiments further provide reduced installation time compared to most common LED retrofit kits. For example, in some embodiments, using only four fasteners and two pre-installed spring clips, an exemplary retrofit kit drastically reduces the amount of labor involved installing the kit. The kit shortens field installation time by eliminating multiple steps that are commonly undertaken when installing typical retrofit kits.

Such steps can include aligning and installing multiple panels, installing fasteners, and using latches which are often troublesome to align. This aids the sales team in acquiring "wins" by reducing the total cost to the consumer, as installation cost is now regarded in equal importance to the customer as the cost of the retrofit kit itself. Moreover, a single exemplary retrofit kit allows lighting auditors to simply count the total number of troffers, rather than keep a count for multiple brands of retrofit kits used in a building.

Lastly, consistent with the structure of some of the embodiments described above, it is noted that alternate embodiments can include creating a series of trim kits that allow a single door to function in troffers of multiple widths. While these alternate embodiments may function like the ones described heretofore, they may still require many variations of the same part.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A retrofit kit for a luminaire, the luminaire installed in a recess of a ceiling plane, the luminaire including a troffer having a troffer length and a troffer width, the retrofit kit comprising:

a set of brackets supporting a belly pan disposed within the troffer, the belly pan disposed along the troffer length;

a door assembly configured to sit below the ceiling plane, the door assembly having an overall door width and an overall door length determined by a maximum width and a maximum length of the recess of the ceiling plane supporting the troffer, the overall door width is greater than the troffer width and the overall door length is approximately equal to the troffer length, an opening of the door assembly having a maximum length corresponding to the troffer length and a maximum width corresponding to the troffer width; and the opening of the door assembly including a diffuser, the diffuser having a width less than the overall door width, the door assembly removably attached to the luminaire by the set of brackets at a fixed location on the door assembly.

2. The retrofit kit of claim 1, wherein the belly pan including a set of light emitting diodes (LEDs).

3. The retrofit kit of claim 1, wherein a door is included in the door assembly configured to be disposed below the ceiling plane.

4. The retrofit kit of claim 3, wherein the door assembly further includes a frame disposed around the door.

5. The retrofit kit of claim 3, wherein the door overlaps the troffer of the luminaire both in width and length.

6. A kit for a luminaire, the luminaire installed in a recess of a ceiling plane, the kit comprising:

a recessed troffer having a troffer length and a troffer width;

a belly pan supportable by a set of brackets, the belly pan configured to be disposed within the recessed troffer extending along the troffer length and disposed above the ceiling plane;

a door assembly configured to mount below the ceiling plane, the door assembly having an overall door width and an overall door length determined by a maximum width and a maximum length of the recess of the ceiling plane supporting the troffer, the overall door width is greater than the troffer width and the overall door length is approximately equal to the troffer length, an opening of the door assembly having a maximum length corresponding to the troffer length and a maximum width corresponding to the troffer width; and the opening of the door assembly including a diffuser, the diffuser having a width dimension less than the overall door width, the door assembly removably attached to the luminaire by the set of brackets at a fixed location on the door assembly.

7. The kit of claim 6, including the belly pan disposed between the recessed troffer of the luminaire and the door assembly.

8. The kit of claim 6, further comprising a driver circuit.

9. The kit of claim 8, wherein the driver circuit is an LED driver circuit.

10. The kit of claim 6, the luminaire including an initial troffer configured to hold fluorescent bulbs, and the kit is configured to adapt the initial troffer to hold LEDs.

11. A kit for a luminaire, the luminaire installed in a recess of a ceiling plane, the kit comprising:

a troffer having a troffer length and a troffer width, the troffer recessed above the ceiling plane;

a set of brackets supporting a belly pan disposed within the troffer, the belly pan disposed along the troffer length;

a door assembly disposed below the ceiling plane, the door assembly having an overall door width and an overall door length determined by a maximum width and a maximum length of the recess of the ceiling plane supporting the troffer, the overall door width is greater than the troffer width and the overall door length is approximately equal to the troffer length, an opening of the door assembly having a maximum length corresponding to the troffer length and a maximum width corresponding to the troffer width;

the opening of the door assembly including a diffuser, the diffuser having a width less than the overall door width, the door assembly removably attached to the luminaire by the set of brackets at a fixed location on the door assembly.

12. The kit of claim 11, wherein a length of the troffer is about 48 inches.

13. The kit of claim 11, wherein a length of the door included is greater than about 48 inches.

14. The kit of claim 11, wherein the belly pan is fastened to the troffer by the set of brackets.

15. The kit of claim 11, wherein the belly pan includes a set of LEDs.

16. The kit of claim 15, further comprising a driver circuit.

17. The kit of claim 16, wherein the driver circuit is an LED driver circuit.

* * * * *